US007946094B2

(12) United States Patent
Huang et al.

(10) Patent No.: US 7,946,094 B2
(45) Date of Patent: May 24, 2011

(54) TOPSIDE BEAM

(75) Inventors: Tianhua Huang, Qingdao (CN); Robert Wang, Qingdao (CN); Ryan Xu, Qingdao (CN); Jack Zhang, Qingdao (CN); Gary Liu, Qingdao (CN)

(73) Assignees: China International Marine Containers (Group) Ltd. (CN); Qingdao CIMC Reefer Trailer Co., Ltd. (CN); Qingdao CIMC Reefer Container Manufacture Co., Ltd. (CN); Qingdao CIMC Special Reefer Co., Ltd. (CN)

( * ) Notice: Subject to any disclaimer, the term of this patent is extended or adjusted under 35 U.S.C. 154(b) by 0 days.

(21) Appl. No.: 12/683,564

(22) Filed: Jan. 7, 2010

(65) Prior Publication Data

US 2010/0205902 A1 Aug. 19, 2010

(30) Foreign Application Priority Data

Feb. 17, 2009 (CN) ..... 2009 2 0005346 U

(51) Int. Cl.
*E04C 3/00* (2006.01)

(52) U.S. Cl. ..... 52/846; 52/79.9; 52/276; 52/281

(58) Field of Classification Search ..... 52/79.9, 52/79.12, 262, 272, 275, 831, 836, 846, 282.1, 52/287.1, 261, 311.1, 58, DIG. 8
See application file for complete search history.

(56) References Cited

U.S. PATENT DOCUMENTS

| | | | | |
|---|---|---|---|---|
| 3,665,666 | A * | 5/1972 | Delcroix | 52/461 |
| 6,367,215 | B1 * | 4/2002 | Laing | 52/271 |
| D553,261 | S * | 10/2007 | Antonic | D25/119 |
| D624,206 | S * | 9/2010 | Antonic | D25/119 |

* cited by examiner

*Primary Examiner* — Brian E Glessner
*Assistant Examiner* — Adam Barlow
(74) *Attorney, Agent, or Firm* — McDonnell Boehnen Hulbert & Berghoff LLP

(57) ABSTRACT

The invention provides a topside beam. The topside beam comprises: an upper topside beam that is comprised of an upper web beam (10), an upper left wing beam (12) and upper right wing beam (11), wherein the section of the upper web beam (10) has a shape of an inverted "L"; the upper left wing beam (12) and the upper right wing beam (11) are oppositely connected to the two sides adjacent to the lower end of the upper web beam (10) respectively; the upper left wing beam (12) opposite to the upper web beam (10) inclines downwardly; and the upper right wing beam (11) is located at 90° with the upper web beam. And a lower topside beam that is comprised of a lower web beam (20) and a lower right wing beam (21), wherein the lower right wing beam (21) is connected to the right side adjacent to the upper end of the lower web beam (20); and the lower right wing beam (21) opposite to the lower web beam (20) inclines upwardly and is parallel to the upper left wing beam (12). And besides, the upper left wing beam (12) and the lower right wing beam (21) are tightly connected by a connecting member.

4 Claims, 3 Drawing Sheets

TOPSIDE BEAM

FIELD OF THE INVENTION

The present invention relates to a connection structure of a roof plate and a side plate in a container, and more particularly a topside beam of the container.

BACKGROUND OF THE INVENTION

FIG. 1 is a sectional view of a topside beam in the prior art. As shown in FIG. 1, because the topside beam 1 in the prior art has an integrated structure, it cannot be transported separately from a roof plate and a side plate of the container, as a result, it is not easy to transport the containers in batches.

SUMMARY OF THE INVENTION

According to the above problem, an object of the invention is to provide a topside beam for facilitating transportation.

For solving the above problem, the invention is implemented by the following technical solutions.

A topside beam comprises an upper topside beam and a lower topside beam, wherein the upper topside beam is comprised of an upper web beam, an upper left wing beam and an upper right wing beam; the section of the upper web beam has a shape of an inverted "L"; the upper left wing beam and the upper right wing beam are connected oppositely to both sides of the upper web beam, respectively, at positions adjacent to a lower end of the upper web beam; and the upper left wing beam inclines downwardly in respect to the upper web beam, the upper right wing beam and the upper web beam form an angle of 90°. Moreover, the lower topside beam is comprised of a lower web beam and a lower right wing beam, wherein the lower right wing beam is connected to a right side of the lower web beam at a location adjacent to an upper end of the lower web beam; the lower right wing beam inclines upwardly in respect to the lower web beam and is parallel to the upper left wing beam. Additionally, the upper topside beam and the lower topside beam are tightly connected by a connecting member.

Furthermore, the upper left wing beam opposite to the upper web beam inclines downwardly 120°.

Additionally, one end of an exterior decorative is riveted to outside of a top end of the upper web beam, the other end is inserted into the upper end of the lower web beam, and a trimming is adhered between the exterior decorative and the upper end of the lower web beam.

And, the exterior decorative is made of a mirror finished stainless steel, and the trimming made of color PVC.

As compared with the prior art, it is available to conduct the separate fabrication and the separate transportation of the roof plate and side plate of the container, by means of the topside beam of the invention, so as to facilitate the transportation and maintenance.

DETAILED DESCRIPTION OF THE PREFERRED EMBODIMENTS

A topside beam of the invention will be described in detail by referring FIGS. 2 and 3 hereinbelow.

Figure 1:
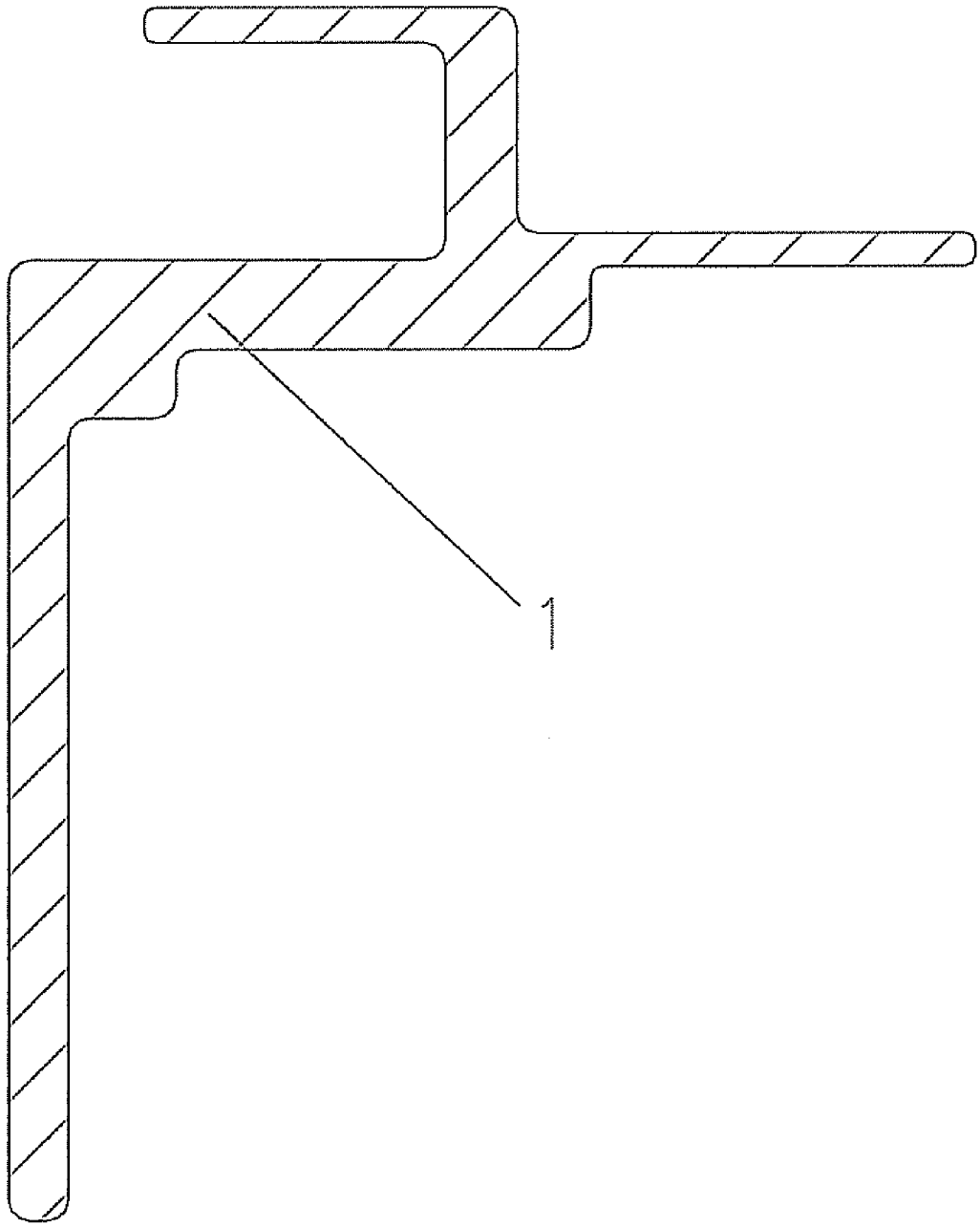
FIG. 1 is a sectional view of a topside beam in the prior art.
Figure 2:
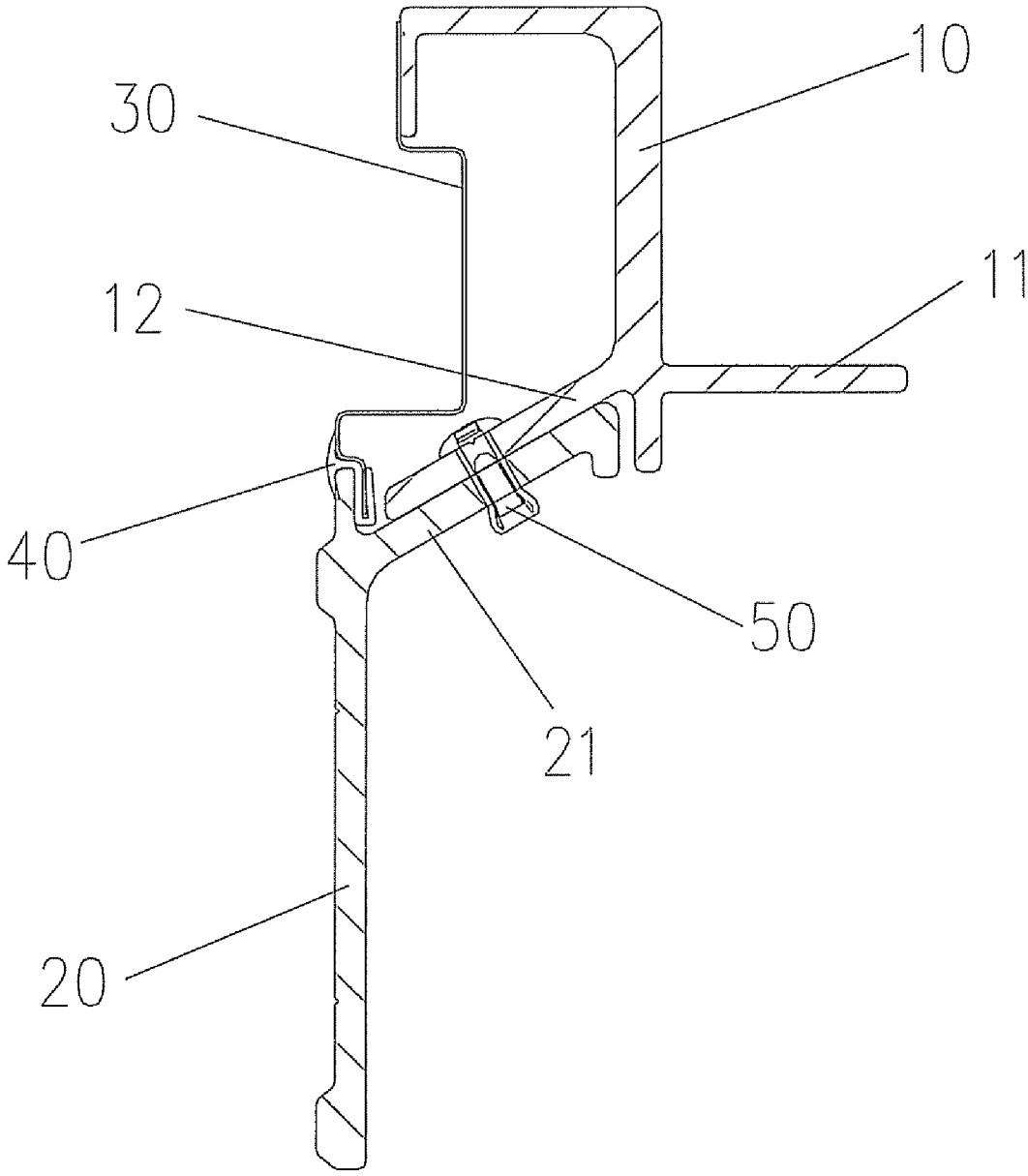
FIG. 2 is a sectional view of a topside beam of the invention.
Figure 3:
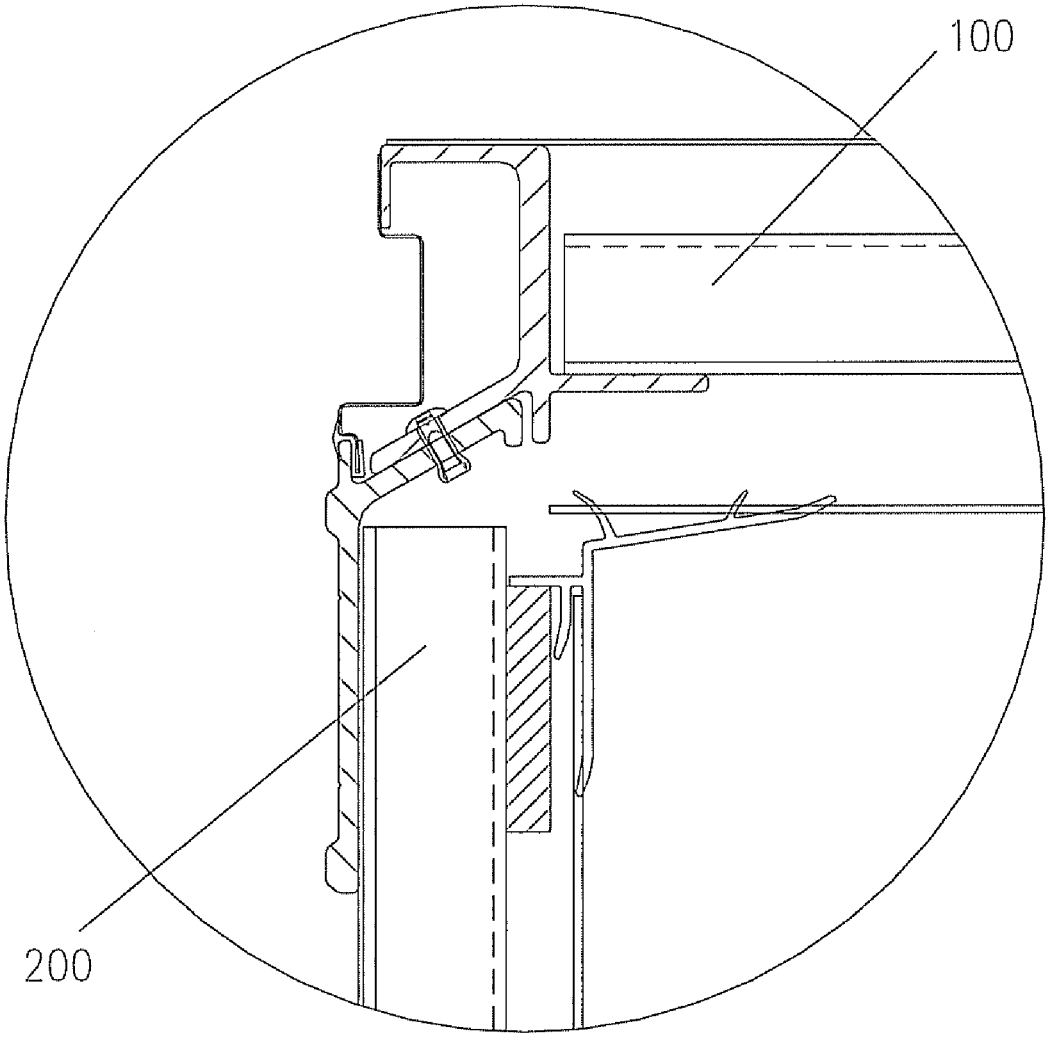
FIG. 3 is a local sectional view of a container assembled with the topside beam of the invention.

FIG. 2 is a sectional view of the topside beam of the invention. As shown in FIG. 2, the topside beam of the invention comprises: an upper topside beam which is comprised of an upper web beam 10, an upper left wing beam 12 and an upper right beam 11; and a lower topside beam which is comprised of a lower web beam 20 and a lower right wing beam 21. As for the upper topside beam, a section of the upper web beam 10 has a shape of an inverted "L"; the upper left wing beam 12 and the upper right wing beam 11 are oppositely connected to both sides of the upper web beam 10, respectively, at positions adjacent to a lower end of the upper web beam 10, and the upper left wing beam 12 inclines downwardly in respect to the upper web beam 10, the upper right wing beam 11 and the upper web beam 10 form an angle of 90°. Here, the inclination angle of the upper left wing beam 12 in respect to the upper web beam 10 is preferably 120°. Additionally, as for the lower topside beam, the lower right wing beam 21 is connected to the right side of the lower web beam 20 at a location adjacent to an upper end of the lower web beam 20, and the lower right wing beam 21 inclines upwardly in respect to the lower web beam 20 and is parallel to the upper left wing beam 12. Besides, in assembling, the upper left wing beam 12 and the lower right wing beam 21 are tightly connected by a rivet 50.

Additionally, one end of an exterior decorative plate 30 made of a mirror finished stainless steel is riveted to outside of a top end of the upper web beam 10, the other end of the exterior decorative plate is inserted to an upper end of the lower web beam 20, and decorative lace 40 made of a color PVC is adhered between the mirror finished stainless steel decorative plate 30 and the upper end of the lower web beam 20, so as to make the appearance of the topside beam of the invention more beautiful. And furthermore, according to various requirements of users, the appearances and colors of the mirror finished stainless decorative plate and the color PVC decorative lace can be changed.

Next, an assembling process for the topside beam of the invention will be described by referring FIG. 3 hereinbelow. The structural characteristics and application of the invention may be explained more detailedly by illustrating the assembling process thereof. FIG. 3 is a local sectional view showing a container assembled with the topside beam of the invention. As shown in FIG. 3, firstly, the upper topside beams are mounted on both sides of a roof plate 100 to form a main frame of the roof plate, so as to implement a separate fabrication of the roof plate. Secondly, a lower topside beam is mounted on a side plate 200 to form a main frame of the side plate, so as to implement a separate fabrication of the side plate.

Then, the roof plate 100, which has been mounted with the upper topside beam, and the side plate 200, which has been mounted with the lower topside beam, are connected together by the rivet 50. Of course, the connecting manners of the topside beam of the invention are not limited to those mentioned above, other manners such as a bolt connection, etc. are also possible.

Therefore, the topside beam of the invention may implement separate fabrication and separate transportation of the roof plate and side plate of the container, so as to facilitate transportation and maintenance.

The invention claimed is:

1. A topside beam comprising:

an upper topside beam comprised of an upper web beam, an upper left wing beam and an upper right wing beam, wherein a section of the upper web beam has a shape of an inverted "L"; the upper left wing beam and the upper right wing beam are oppositely connected to both sides of the upper web beam, respectively, at positions adjacent to a lower end of the upper web beam; and the upper left wing beam inclines downwardly in respect to the upper web beam, the upper right wing beam and the upper web beam form an angel of 90°;

a lower topside beam comprised of a lower web beam and a lower right wing beam, wherein the lower right wing beam is connected to a right side of the lower web beam at a position adjacent to an upper end of the lower web beam, and the lower right wing beam inclines upwardly in respect to the lower web beam and is parallel to the upper left wing beam; and the upper left wing beam and the lower right wing beam are tightly connected by a connecting member.

2. The topside beam according to claim 1, wherein the upper left wing beam inclines downwardly 120° in respect to the upper web beam.

3. The topside beam according to claim 1, wherein one end of an exterior decorative plate is riveted to outside of a top end of the upper web beam, and the other end of the exterior decorative plate is inserted to an upper end of the lower web beam; and a decorative lace is adhered between the exterior decorative plate and the upper end of the lower web beam.

4. The topside beam according to claim 3, wherein the exterior decorative plate is made of a mirror finished stainless steel, and the decorative lace is made of a color PVC.

* * * * *